US008893981B2

(12) United States Patent
Farrell

(10) Patent No.: US 8,893,981 B2
(45) Date of Patent: Nov. 25, 2014

(54) HEATING SYSTEM

(75) Inventor: Christopher C. Farrell, Plymouth (GB)

(73) Assignee: Zenex Technologies Limited, Exeter, Devon (GB)

( * ) Notice: Subject to any disclaimer, the term of this patent is extended or adjusted under 35 U.S.C. 154(b) by 1291 days.

(21) Appl. No.: 12/397,475

(22) Filed: Mar. 4, 2009

(65) Prior Publication Data

US 2009/0223658 A1 Sep. 10, 2009

(30) Foreign Application Priority Data

Mar. 5, 2008 (GB) ..... 0804124.6

(51) Int. Cl.

| | |
|---|---|
| ***F24D 3/08*** | (2006.01) |
| ***F24D 3/00*** | (2006.01) |
| ***F24D 11/00*** | (2006.01) |
| ***F24D 19/10*** | (2006.01) |
| *F24D 17/00* | (2006.01) |

(52) U.S. Cl.

CPC ..... *F24D 3/08* (2013.01); *F24D 11/004* (2013.01); *F24D 17/0031* (2013.01); *F24D 19/1066* (2013.01)

USPC ..... 237/56; 237/19; 165/104.19; 165/296

(58) Field of Classification Search

USPC ..... 237/56, 19; 165/296, 104.19

See application file for complete search history.

(56) References Cited

U.S. PATENT DOCUMENTS

| | | | | |
|---|---|---|---|---|
| 2,327,339 | A * | 8/1943 | Chandler | 237/8 R |
| 3,178,113 | A * | 4/1965 | Curry et al. | 237/8 R |
| 4,135,571 | A * | 1/1979 | Tamblyn et al. | 165/236 |
| 4,243,871 | A * | 1/1981 | McKenney | 392/341 |
| 4,341,263 | A * | 7/1982 | Arbabian | 165/296 |
| 4,406,136 | A * | 9/1983 | Picchiottino | 62/238.6 |
| 4,426,037 | A * | 1/1984 | Bernstein | 237/19 |
| 5,118,039 | A * | 6/1992 | Williams, Jr. | 237/7 |
| 5,192,022 | A * | 3/1993 | Swenson | 237/2 B |
| 5,226,594 | A * | 7/1993 | Swenson | 237/2 B |
| 6,364,002 | B1 * | 4/2002 | Hennig et al. | 165/10 |
| 6,594,447 | B2 * | 7/2003 | Rixen | 392/496 |
| 7,415,944 | B2 * | 8/2008 | Farrell | 122/20 B |
| 2006/0144347 | A1 * | 7/2006 | Farrell | 122/135.1 |

(Continued)

FOREIGN PATENT DOCUMENTS

| | | | |
|---|---|---|---|
| DE | 2460067 | A * | 12/1974 |
| DE | 2460067 | A1 * | 12/1974 |

(Continued)

OTHER PUBLICATIONS

Search Report dated Aug. 22, 2008 from corresponding British Application No. GB 0804124.6.

(Continued)

*Primary Examiner* — Kang Hu
*Assistant Examiner* — Phillip E Decker
(74) *Attorney, Agent, or Firm* — Wolf, Greenfield & Sacks, P.C.

(57) ABSTRACT

A heating system comprises a heater and a local heat exchange system in which the local heat exchange system comprises: a primary heat exchanger; a heat store having a secondary heat exchanger; a cold water inlet; and a hot water outlet, in which the local heat exchange system is remotely located from the heater, the primary heat exchanger and the heat store are arranged so as to be heated by the heater, and the primary and secondary heat exchangers are in fluid-flow communication with the cold water inlet and the hot water outlet.

15 Claims, 5 Drawing Sheets

(56) References Cited

U.S. PATENT DOCUMENTS

| | | | | |
|---|---|---|---|---|
| 2006/0196958 | A1* | 9/2006 | Dancey et al. | 237/67 |
| 2007/0108304 | A1* | 5/2007 | Seki | 237/12 |
| 2007/0295826 | A1* | 12/2007 | Farrell | 237/19 |
| 2008/0023961 | A1* | 1/2008 | Cho et al. | 290/2 |
| 2009/0090310 | A1* | 4/2009 | Farrell | 122/20 A |
| 2009/0277618 | A1* | 11/2009 | Farrell et al. | 165/110 |
| 2009/0314464 | A1* | 12/2009 | Farrell | 165/57 |
| 2010/0230088 | A1* | 9/2010 | Clark et al. | 165/287 |
| 2011/0017152 | A1* | 1/2011 | Min | 122/19.1 |
| 2012/0125269 | A1* | 5/2012 | Farrell | 122/18.4 |

FOREIGN PATENT DOCUMENTS

| | | | | |
|---|---|---|---|---|
| DE | 2460067 | A1 * | 7/1976 | |
| DE | 31 23 875 | A1 | 3/1982 | |
| EP | 1 371 910 | A2 | 12/2003 | |
| EP | 2098789 | A2 * | 9/2009 | F24D 3/08 |
| GB | 2203525 | A * | 10/1988 | F28D 1/00 |
| GB | 2 250 334 | A | 6/1992 | |
| GB | 2 255 161 | A | 10/1992 | |
| GB | 2365953 | A * | 2/2002 | F24D 3/08 |
| GB | 2 431 228 | A | 4/2007 | |
| WO | WO 92/06336 | A1 | 4/1992 | |
| WO | WO 2006/051259 | A1 | 5/2006 | |
| WO | WO 2007/051967 | A1 | 5/2007 | |

OTHER PUBLICATIONS

Search Report dated Nov. 22, 2013 from corresponding European Application No. 09153650.8.

* cited by examiner

HEATING SYSTEM

FIELD OF THE INVENTION

This invention relates to an efficient heating system for the supply of hot water to multiple users. The invention is particularly suitable for the supply of hot water in a building such as a block of flats, a hotel, a hospital or a leisure centre. This is not exhaustive.

BACKGROUND OF THE INVENTION

In a prior art combined hot water supply and space heating system 1 shown in FIG. 1, cold water from a mains supply 2 is heated by a boiler 4 and stored in a hot water tank 6 having a heat exchange coil 8. Hot water from the hot water tank 6 is conveyed through pipes to outlets 10 and 12 which may, for example, be hot water taps and which are distributed around a building at different locations or areas 14 and 16 respectively. Each location 14 or 16 may, for example, be a room or a flat. In response to demand for hot water at the hot water outlet 10, hot water is drawn from a tank outlet 18 located towards the top of the hot water storage tank 6. The hot water drawn from the hot water storage tank 6 is replenished with cold water from the mains supply 2 via an inlet 20 located towards the bottom of the hot water tank 6.

In general, cold water outlets such as cold water taps 22 and 24 are also located with the hot water outlets 10 and 12 respectively. In response to a demand for cold water at cold water outlets 22 and 24, cold water is supplied from the mains supply 2.

When producing hot water on a commercial scale, there is generally a background level of substantially constant (mean) hot water usage. Therefore, in order to satisfy a peak demand, either a large hot water tank is required such that the water in such a tank can be heated when the boiler (which should be construed to include a heater) has a spare capacity to do so, or alternatively, the boiler must be rated for the maximum expected demand and hence a larger and more expensive boiler system is required which generally runs at below its peak capacity. In the former case the capacity of the hot water storage tank is likely to be of the order of several hundred liters. Once the hot water stored in such a large tank is depleted, it can take a long time for the boiler to heat the cold water drawn into the tank to replenish the hot water drawn from the tank. This can be particularly problematic when the different areas 14 or 16 are not located in the same private residence. If area 14 corresponds to a first flat occupied by a first user and area 16 corresponds to a second flat occupied by a second user, for example, neither of the first or second users is likely to be motivated to conserve hot water. Thus, the first user may exhaust the hot water stored in the hot water storage tank 6 to the detriment of the second user who will not be able to draw any hot water until the water in the hot water storage tank 6 has been heated via the heat exchange coil 8 when the boiler 4 is operated.

The combined hot water supply and space heating system 1 also comprises space heaters 26 and 28 located in areas 14 and 16 respectively. The space heaters 26 and 28 are connected in parallel across the primary circuit of the boiler 4 so that, for combined hot and cold water supply and space heating, each area 14 and 16 must be serviced by four pipes. This can be problematic especially when access is restricted as is often the case in older buildings when routing pipe-work into different areas can be time-consuming and costly.

SUMMARY OF INVENTION

According to the first aspect of the present invention there is provided a heating system comprising a heater and a plurality of local heat exchange systems located remotely from the heater, the local heat exchange systems comprising: a cold water inlet; a hot water outlet; a heat exchange fluid inlet for receiving a warmed heat exchange fluid from the heater; a heat exchange fluid outlet for returning heat exchange fluid to the heater; a primary heat exchanger; a heat store having a secondary heat exchanger; wherein the primary heat exchanger and the heat store are in fluid flow communication with the heat exchange fluid inlet, and a first valve is provided to mix water from the cold water inlet with water passing through the secondary heat exchanger, and an outlet of the valve is connected to an inlet of the primary heat exchanger.

The or each local heat exchange system may, for example, be located in a particular locality or area within a building which is remote from a centrally-located heater. The local heat exchange system may, for example, supply hot water in a flat within a block of flats. An advantage of such a heating system is that the hot water supplied by the local heat exchange system is more independent of other hot water demands on the heating system from further localities or users when compared to a conventional hot water supply system. The local storage of heat and the local hot water supply that results from such local heat storage may be deliberately sized by the building operator such that the storage can be exhausted by a user of the local hot water supply. Such a user is thereby motivated to conserve hot water.

Preferably the heat store is sized so as to supplement the heating capacity of the primary heat exchanger during a peak local demand such as that occurring when a user fills a bath.

Preferably, the heat store has a capacity of between 10 and 100 liters. More preferably, the heat store has a capacity of between 15 and 50 liters.

Advantageously, when heat stored in the heat store is used to heat cold water, the heat so used is replenished when the heater has the spare heating capacity to do so.

Preferably, the heat store and the primary heat exchanger are connected in parallel across the heat exchange fluid inlet and the heat exchange fluid outlet of a local heat exchange system.

Preferably, the local heat exchange system further comprises at least one additional heater and the heat store further comprises a tertiary heat exchanger. The space heater(s) is arranged to receive warmed further heat exchange fluid from the tertiary heat exchanger.

Thus, a local hot water demand and a local space heating requirement may both be met by the supply of heat via a heat exchange fluid which, is use, is delivered to the or each space heater and the heat store and/or the primary heat exchanger. Thus, in addition to the provision of a cold water mains inlet, the hot water and space heating requirements in a given locality may be met by the provision of the heat exchange fluid inlet and the heat exchange fluid outlet associated with the locality. Accordingly, there is no requirement for a separate hot water supply to the locality, e.g. to each individual flat. This may be particularly advantageous in older properties.

Advantageously, the local heat exchange system further comprises a diverting valve having an inlet connected to the heater, a first outlet connected to an inlet of the heat store, and a second outlet connected to an inlet of the primary heat exchanger. The diverting valve is controllable so as to control the delivery of the heat exchange fluid to the heat store and the primary heat exchanger. Hence, depending on the temperature and flow rate of the hot water required at the hot water outlet, the heat exchange fluid may be diverted towards the primary heat exchanger to transfer the maximum amount of heat to the water on its path towards the hot water outlet. This is particularly advantageous it for example, the local hot water demand exceeds that which can be supplied from the heat store alone, or if the system is operated such that the heat store is always used to protect the water provided the primary heat exchanger.

Advantageously the first valve is a blending valve. Warmed water from the outlet of the secondary heat exchanger is combined with cold water from the cold water inlet at the blending valve and the blending valve is, advantageously, controllable so as to combine the warmed water and the cold water in desired proportions.

Thus, depending on the local hot water demand, the blending valve may blend water warmed at the secondary heat exchanger with cold water to achieve a desired temperature of the hot water at the hot water outlet, or at the inlet to the secondary heat exchanger.

BRIEF DESCRIPTION OF THE DRAWINGS

The present invention will be further described by way of non-limiting example only with reference to the following Figures in which.

DESCRIPTION OF PREFERRED EMBODIMENTS OF THE INVENTION

Figure 1:
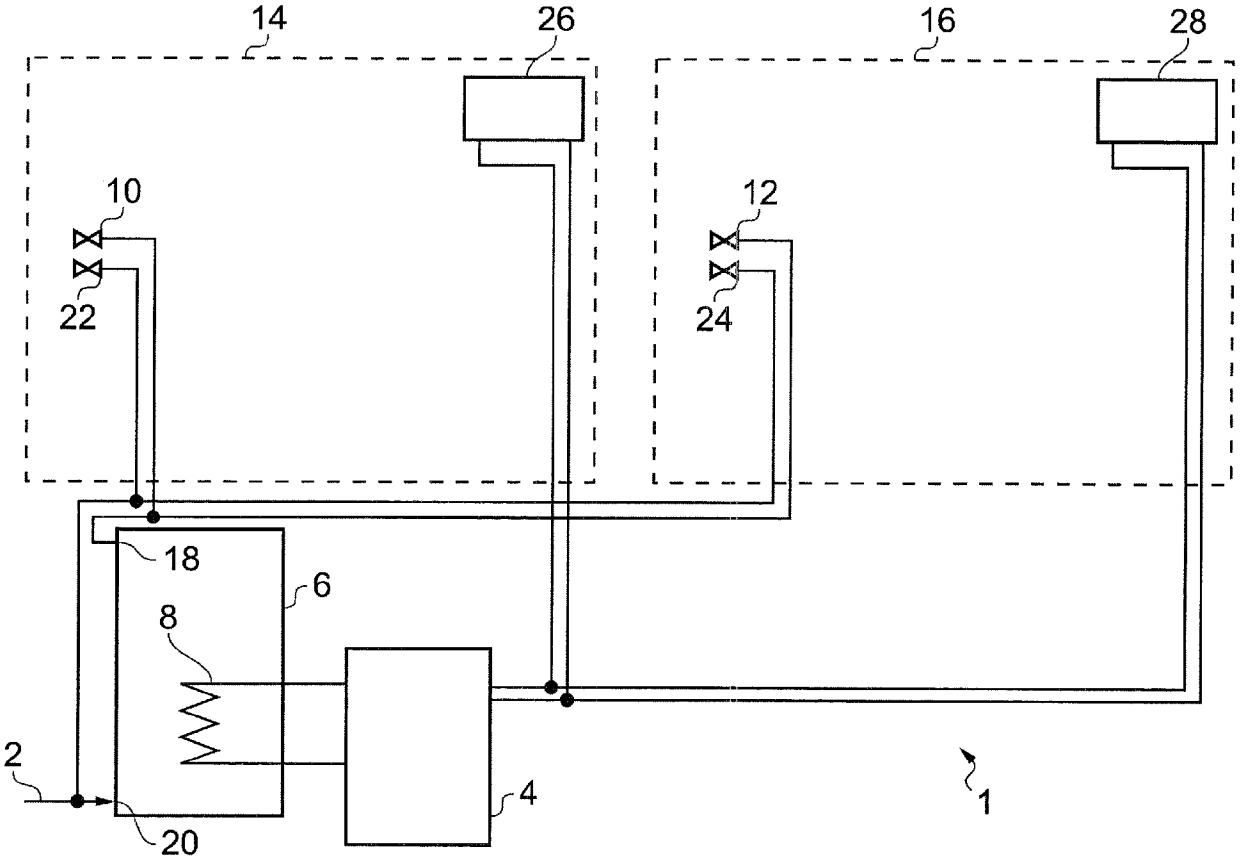
FIG. 1 (Prior Art)
FIG. 1 is a schematic representation of a prior art combined hot water supply and space heating system.
Figure 2:
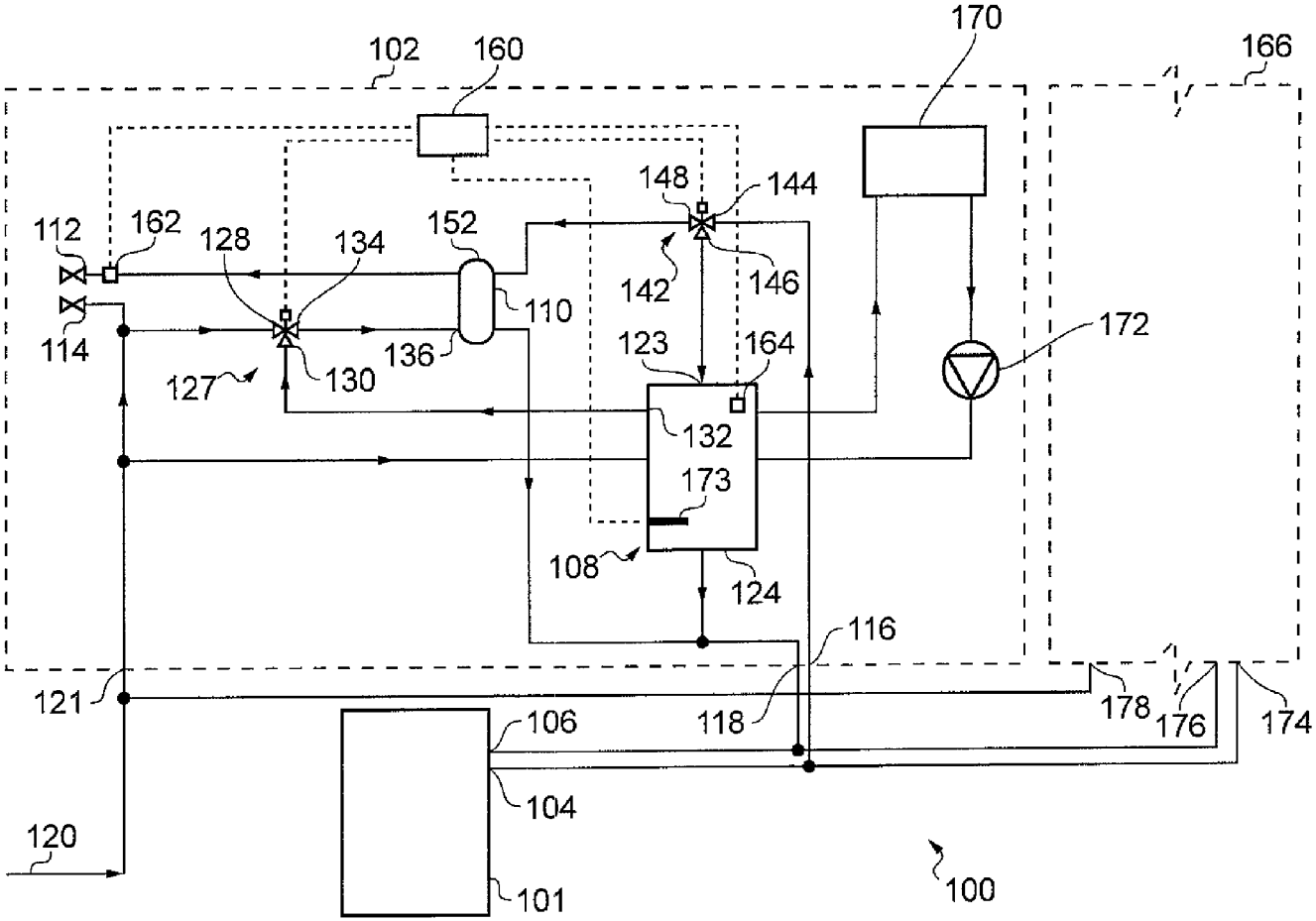
FIG. 2 is a schematic representation of a combined hot water supply and space heating system constituting a first embodiment of the present invention.

A combined hot water supply and space heating system 100 is shown in FIG. 2 and comprises a heater 101 and a first local heat exchange system 102 which is located remotely from the heater 101. The beater 101 may, for example, be a boiler and may in particular be a gas-fired or an oil-fired boiler. The heater 101 further comprises a primary circuit outlet 104 for delivering warmed water to local heat exchange systems and a primary circuit inlet 106 to which the water is returned. The first local heat exchange system 102 comprises a heat store 108, a primary heat exchanger 110, a hot water outlet 112, a cold water outlet 114, a heat exchange fluid inlet 116 and a heat exchange fluid outlet 118. The heat store 108 and the primary heat exchanger 110 are connected in parallel in a fluid flow path between the heat exchange fluid inlet 116 and the heat exchange fluid outlet 118. The heat exchange fluid inlet 116 is connected to the primary circuit outlet 104 of the heater 101 and the heat exchange fluid outlet 118 is connected to the primary circuit inlet 106 of the heater 101 thereby forming part of a primary circuit of the heater 101. In use, the heater 101 heats a heat exchange fluid which is pumped around the primary circuit and transfers heat to the heat store 108 and/or the primary heat exchanger 110. The heat exchange fluid may, for example, flow around the primary circuit in response to the operation of a pump which is housed within the heater 101.

In use, cold water is supplied to the local heat exchange system 102 from the cold water main 120 via a cold water inlet 121 and is heated, as will be described later, at the heat store 108 and/or the primary heat exchanger 110 so as to provide warmed water at the hot water outlet 112.

In response to a demand for cold water at the cold water outlet 114, cold water from the cold water main supply 120 enters the local heat exchange system 102 via the cold water inlet 121 and is provided at the cold water outlet 114. The cold water outlet 114 may, for example, be located with or adjacent the hot water outlet 112.

Figure 3:
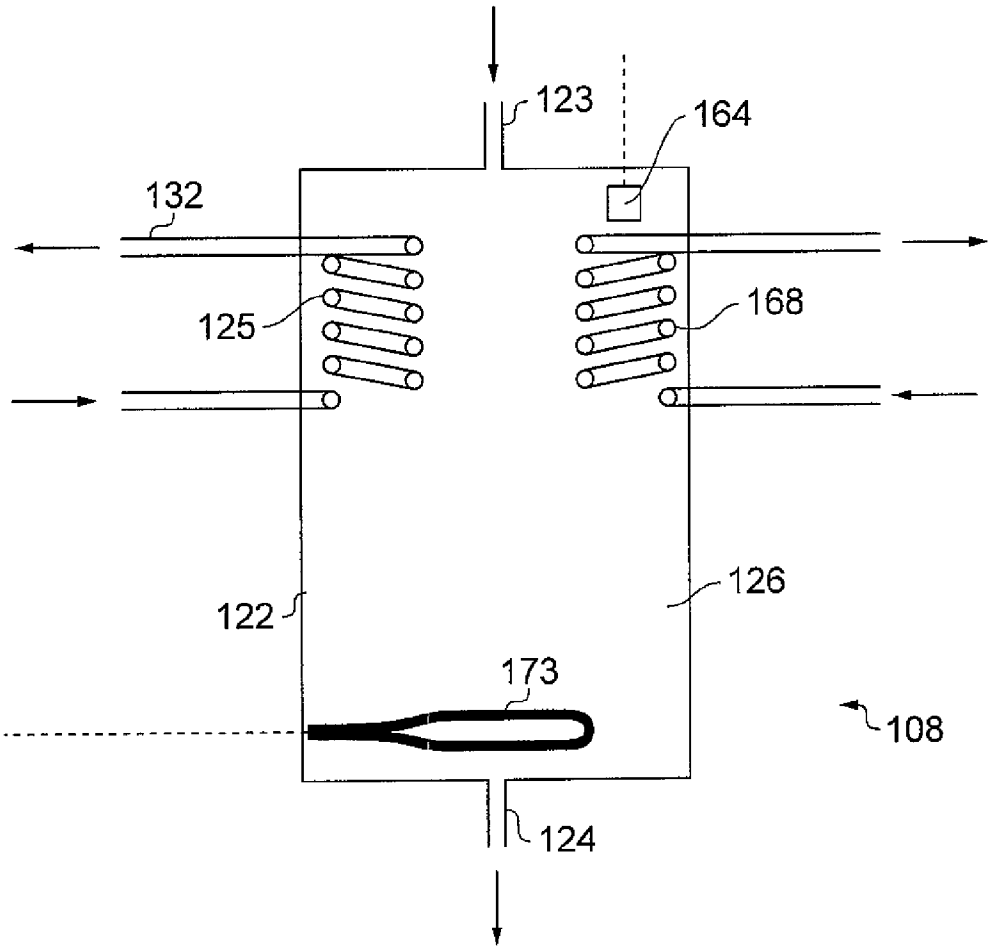
FIG. 3 shows a heat store of the combined hot water supply and space heating system of FIG. 2 in greater detail.

The heat store 108 is shown in greater detail in FIG. 3 and comprises an enclosure (or tank) 122, a heat exchange fluid inlet 123, a heat exchange fluid outlet 124 and a secondary heat exchanger 125. The enclosure 122 contains the heat exchange fluid 126 which surrounds the secondary heat exchanger 125. As shown in FIG. 3, the secondary heat exchanger 125 may, for example, be a coiled pipe having one end connected to the cold water supply. Returning to FIG. 2, the first local heat exchange system 102 further comprises a blending valve 127 having a first inlet 128 connected to the cold water inlet 121, a second inlet 130 connected to an outlet 132 of the secondary heat exchanger 125, and an outlet 134 connected to a first inlet 136 of the primary heat exchanger 110. Warmed water from the outlet 132 of the secondary heat exchanger 125 (but in alternative embodiments it could be connected to an outlet of the heat store if the heat store contains potable (drinkable) water) may be combined with cold water from the cold water inlet 121 at the blending valve 127. Furthermore, the blending valve 127 is controllable so as to combine the water warmed by the secondary heat exchanger 125 and the cold water from the cold water inlet 121 in different proportions. The valve 127 may blend the water admitted to the primary heat exchanger 110 to a target temperature of 25 to 35° C.

The first local heat exchange system 102 optionally further comprises a diverting valve 142 having an inlet 144, a first outlet 146 and a second outlet 148. The inlet 144 of the diverting valve 142 is connected to the heat exchange fluid inlet 116 of the first local heat exchange system 102, the first outlet 146 of the diverting valve 142 is connected to the heat exchange fluid inlet 123 of the heat store 108, and the second outlet 148 of the diverting valve 142 is connected to a second inlet 152 of the primary heat exchanger 110. The diverting valve 142 is controllable so as to control or vary delivery of the heat exchange fluid to the heat store 108 and the primary heat exchanger 110.

The first local heat exchange system 102 further comprises a controller 160 and associated temperature sensors 162 and 164. The temperature sensor 162 is located at the hot water outlet 112 and monitors the temperature of the hot water supplied at the hot water outlet 112, while the temperature sensor 164 is located in or at the heat store 108 and monitors the temperature of the heat exchange fluid 126. The controller 160 in communication with the blending valve 127, the diverting valve 142 and the temperature sensors 162 and 164 as indicated by the dotted lines in FIG. 2.

In use, the controller 160 controls the blending valve 127 and/or the diverting valve 142 in response to the temperature sensed at the hot water outlet 112 by the temperature sensor 162. In response to a demand for hot water at the hot water outlet 112, for example, the temperature at the hot water outlet 112 may fall and the controller 160 may operate the blending valve 127 so as to reduce the proportion of cold water admitted by the blending valve 127 so as to increase the temperature of the water leaving the blending valve outlet 134. Additionally or alternatively, the controller may control the diverting valve 142 to direct a higher proportion of the beat exchange fluid towards the primary heat exchanger 110. Control of the blending valve 127 and/or the diverting valve 142 in this way results in a temperature increase at the hot water outlet 112. The proportion of cold water blended at the blending valve 127 may be further reduced and/or the proportion of heat exchange fluid directed by the diverting valve 142 towards the primary heat exchanger 110 may be further increased until the temperature at the hot water outlet 112 reaches a desired set-point temperature or until the water provided at the hot water outlet 112 is as hot as possible.

The purpose of the temperature sensor 164 is to provide feedback to the controller 160 of a temperature of the heat exchange fluid 126 within the heat store 108. This facilitates a mode of operation whereby, when the temperature of the heat exchange fluid 126 within the heat store 108 reaches a desired set-point temperature, the controller may control the diverting valve 142 so as to either direct more of the heat exchange fluid towards the primary heat exchanger 110, or to stop the flow of the heat exchange fluid at the inlet 144 of the diverting valve 142 altogether. The heater 101 only has a finite heating capacity so that stopping the flow of the heat exchange fluid at the inlet 144 of the diverting valve 142 altogether in this way, may be advantageous since it reduces heating demand on the heater 101 or allows the heat carried by the heat exchange fluid to be redirected towards a further local heat exchange system 166.

As shown in FIG. 3, the heat store 108 may further comprise a tertiary heat exchanger 168 in the form of a coiled pipe surrounded by the heat exchange fluid 126. The local heat exchange system 102 shown in FIG. 2 also comprises a space heater 170 connected in parallel with the tertiary heat exchanger 168 so as to form a closed space heating circuit containing a further heat exchange fluid which is pumped around the space heating circuit by a pump 172. Heat is transferred between the heat exchange fluid and the further heat exchange fluid at the tertiary heat exchanger 168. In this way, heat is transferred to the space heater 170 so as to heat a space in the locality of the local heat exchange system 102. It should be understood that although only one space heater 170 has been shown in FIG. 2 for clarity, further space heaters (not shown) may also be connected in parallel with the space heater 170 so as to form part of the space heating circuit. Alternatively, if there is no requirement for any space heating at a particular locality, the tertiary heat exchanger 168, the space heater 170 and the pump 172 may be omitted from the corresponding local heat exchange system 102.

The heat store may 108 further comprise an additional heater, such as an electric a heating element 173 which is surrounded by the beat exchange fluid 126. The heating element 173 is in communication with the controller 160. In use, an electric current may be passed through the heating element 173 thus heating the heat exchange fluid 126. The heating element 173 therefore constitutes a supplementary source of heat which may be activated independently of the heater 101.

It should be understood that the further local heat exchange system 166 comprises features (not shown) which correspond to the features of the first local heat exchange system 102 and, in particular, that it has a heat exchange fluid inlet 174, a heat exchange fluid outlet 176 and a cold water inlet 178. The combined hot water supply and space heating system 100 of FIG. 2 thus enables the provision of hot and cold water for washing, bathing and the like and the provision of space heating in different areas which may be distributed around a building. Each area has an associated local heat exchange system (102, 166) which only requires a heat exchange fluid inlet (116, 174), a heat exchange fluid outlet (118, 176) and a cold water inlet (121, 178) for the provision of hot and cold water and space heating in that area.

Figure 4:
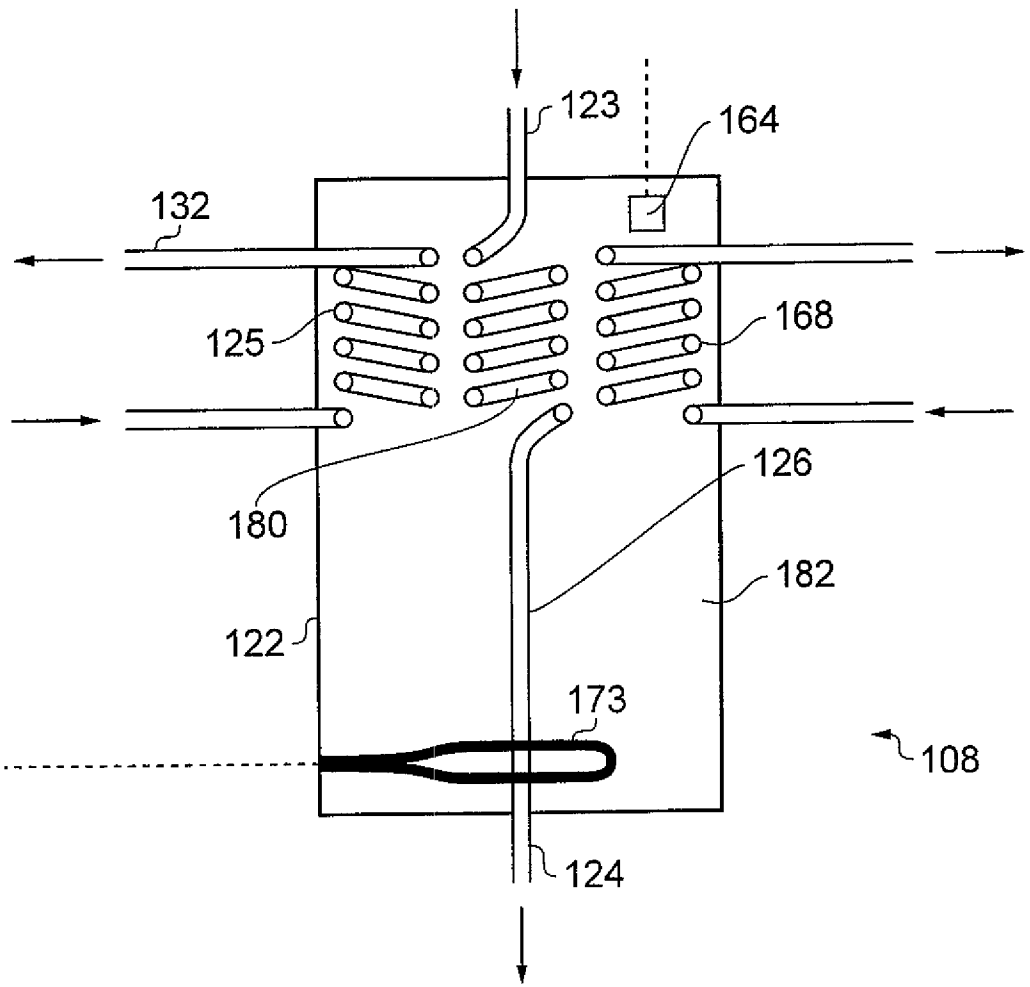
FIG. 4 shows a variant of the heat store of FIG. 3.

FIG. 4 shows a variant of the heat store 108 of FIG. 3. The features of FIG. 4 which also appear in FIG. 3 are identified using the same reference numerals. The heat store 108 shown in FIG. 4 differs from that shown in FIG. 3 in that the heat store 108 shown in FIG. 4 further comprises a quaternary heat exchanger 180 which may, for example, comprise a coiled pipe. The quaternary heat exchanger 180 is connected between the heat exchange fluid inlet 123 and the heat exchange fluid outlet 124 and contains the heat exchange fluid 126. The enclosure 122 of the heat store of FIG. 4 also contains a heat storage medium 182 which surrounds the quaternary heat exchanger 180 and which may, for example, be water. This enclosure may include a pressure relief system (not shown) to control water pressure within the enclosure 122.

Figure 5:
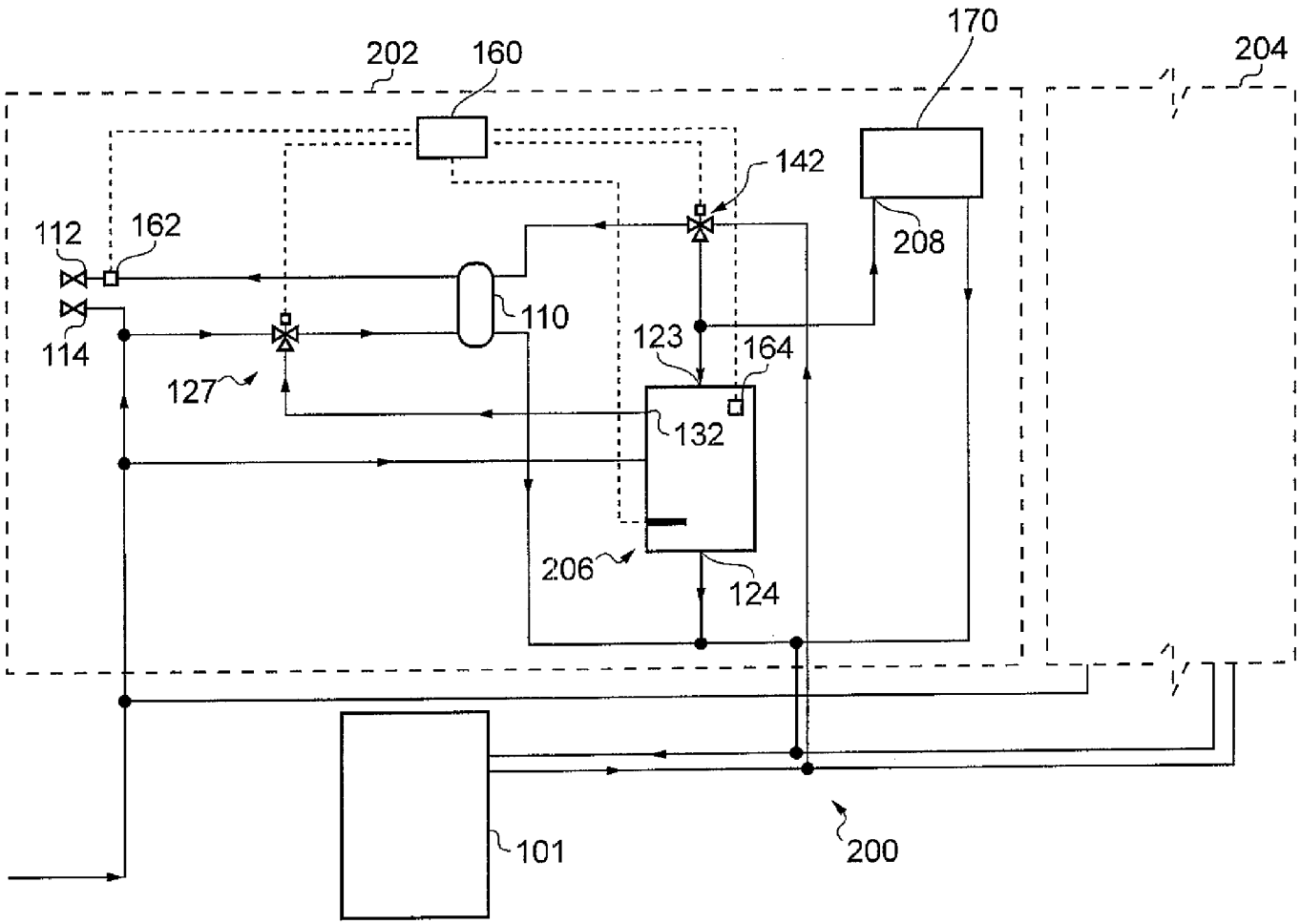
FIG. 5 is a schematic representation of a combined hot water supply and space heating system constituting an alternative embodiment of the present invention.

FIG. 5 shows an alternative embodiment of a combined hot water supply and space heating system 200 which comprises local heat exchange systems 202 and 204 having many of the same features as the local heat exchange systems 102 and 166 of the combined hot water supply and space heating system 100 of FIG. 2. The local heat exchange system 202 comprises a heat store 206 which only differs from the variants of the heat store 108 shown in FIGS. 3 and 4 in that the tertiary heat exchanger 168 is not present. Furthermore, the space heater 170 is connected in parallel across the heat store 206 so as to form part of the primary circuit of the heater 101. The space heater 170 in FIG. 5 is, accordingly, heated directly by the heat exchange fluid 126 in the primary circuit of the heater 101. Additional space heaters (not shown) may also be connected in parallel across the heat store 206 and the space heater 170 so as to form part of the primary circuit of the heater 101.

In a further alternative embodiment of a combined hot water supply and space heating system (not shown) the 3-way diverting valve 142 of FIG. 5 is replaced by a 4-way diverting valve identical to the 3-way diverting valve 142 except that it has an additional outlet which is connected to the inlet 208 of the space heater 170.

It should be understood that the number of local heat exchange systems connected to any given heater may be limited only by the heating capacity of the heater. Thus, although only two local heat exchange systems have been shown in the foregoing embodiments, the number of local heat exchange systems may be greater or less than this.

In further variations, the primary heat exchanger and the heat store may be connected in series, preferably with the primary heat store being arranged to receive water from the heater 101 before the water enters the heat store. In heat stores of the type shown in FIG. 4 where water from the heater/boiler is contained within beat exchanger 180, then heat exchanger 125 can be omitted, and the heat store can be directly connected between the cold water inlet and the blending valve 130 such that the heat store contains potable water.

Thus, a heating system is provided in which a central heater can supply hot water and/or space heating to one or more localities to service the needs of users in the different localities. Such a system encourages efficient use of hot water and enables the cost-effective facilitation of the supply of hot water and/or the provision of space heating to the different localities.

The invention claimed is:

1. A heating system comprising a plurality of local heat exchange systems for providing hot water to respective locations located remotely from a heater, individual ones of the local heat exchange systems comprising:

a cold water inlet for receiving cold water from a water supply;

a hot water outlet for providing hot water to a tap;

a heat exchange fluid inlet for receiving a warmed heat exchange fluid from the heater;

a heat exchange fluid outlet for returning heat exchange fluid to the heater;

a primary heat exchanger having a primary heat exchanger first fluid inlet in fluid flow communication with a primary heat exchanger first fluid outlet, and a primary heat exchanger second fluid inlet in fluid flow communication with a primary heat exchanger second fluid outlet;

a heat store having a heat store fluid inlet, a heat store fluid outlet and a secondary heat exchanger, the secondary heat exchanger having a secondary heat exchanger inlet and a secondary heat exchanger outlet, where the secondary heat exchanger inlet is arranged to receive water from the cold water inlet;

wherein the primary heat exchanger first fluid inlet and the heat store fluid inlet are in fluid flow communication with the heat exchange fluid inlet, and a first valve has a first inlet connected to the cold water inlet, a second inlet connected to the secondary heat exchanger outlet, and the first valve is arranged to mix water from the cold water inlet with water passing through the secondary heat exchanger, and an outlet of the first valve is connected to the primary heat exchanger second fluid inlet and the primary heat exchanger second fluid outlet is connected to the hot water outlet; and wherein the first outlet of the primary heat exchanger and the outlet of the heat store are connected to the heat exchange fluid outlet.

2. The heating system of claim 1, in which the heat store has a capacity of between 10 and 100 liters.

3. The heating system of claim 2, in which the heat store has a capacity of between 15 and 50 liters.

4. The heating system of claim 1, in which the local heat exchange system further comprises a space heater and the heat store further comprises a tertiary heat exchanger and the space heater is arranged to receive warmed further heat exchange fluid from the tertiary heat exchanger.

5. The heating system of claim 1, in which the heat exchange fluid surrounds the secondary heat exchanger.

6. The heating system of claim 1, in which the heat store further comprises a heat storage medium, and in which heat is exchanged between the heat exchange fluid and the heat storage medium.

7. The heating system of claim 6, in which the heat store further comprises a quaternary heat exchanger, the heat exchange fluid is delivered to the quaternary heat exchanger and heat is exchanged between the heat exchange fluid and the heat storage medium by the quaternary heat exchanger.

8. The heating system of claim 1, in which the at least one local heat exchange system further comprises a diverting valve having an inlet connected to the heat exchange fluid inlet, a first outlet connected to the heat store fluid inlet, and a second outlet connected to the primary heat exchanger first fluid inlet, in which the diverting valve is controllable so as to control the delivery of the heat exchange fluid to the heat store and the primary heat exchanger.

9. The heating system of claim 8, in which the at least one local heat exchange system further comprises a controller and a temperature sensor for measuring a temperature of the hot water at the hot water outlet and, in response to the temperature measured by the temperature sensor, the controller controls the operation of the diverting valve and/or the first valve.

10. The heating system of claim 9, in which the local heat exchange system further comprises a further temperature sensor for measuring a temperature of the heat exchange fluid or the heat storage medium in the heat store and, in response to the temperature measured by the further temperature sensor, the controller controls the operation of the diverting valve and/or the first valve.

11. The heating system of claim 1, in which the heat store is unvented.

12. The heating system of claim 1, further including a heater to warm the heat exchange fluid.

13. The heating system of claim 1, further comprising:

a further local heat exchange system comprising:

a further primary heat exchanger;

a further heat store having a further secondary heat exchanger;

a further cold water inlet; and a further hot water outlet in which the further local heat exchange system is remotely located from the heater, the further primary heat exchanger and the further heat store are arranged so as to be heated by the heater, and the further primary and further secondary heat exchangers are in fluid-flow communication with the further cold water inlet and the further hot water outlet.

14. The heating system of claim 13, in which the local heat exchange system is located at a first location and the further local heat exchange system is located at a second location remote from the first location.

15. The heating system of claim 13, further including a heater to warm the heat exchange fluid.

* * * * *